United States Patent [19]

Pliefke et al.

[11] Patent Number: 4,492,616

[45] Date of Patent: Jan. 8, 1985

[54] PROCESS FOR TREATING ALUMINUM OXIDE LAYERS AND USE IN THE MANUFACTURE OF OFFSET-PRINTING PLATES

[75] Inventors: Engelbert Pliefke; Gerhard Usbeck, both of Wiesbaden, Fed. Rep. of Germany

[73] Assignee: Hoechst Aktiengesellschaft, Frankfurt am Main, Fed. Rep. of Germany

[21] Appl. No.: 524,591

[22] Filed: Aug. 19, 1983

[30] Foreign Application Priority Data

Sep. 1, 1982 [DE] Fed. Rep. of Germany ..... 3232485

[51] Int. Cl.[3] ..... C25D 11/16; C25D 11/18

[52] U.S. Cl. ..... 204/33; 204/38 A; 204/58; 204/129.75; 101/456; 101/459; 430/159; 430/278; 430/300; 430/302; 430/327

[58] Field of Search ..... 204/38 A, 33, 58, 129.75; 101/459, 456; 430/159, 278, 300, 302, 327, 310

[56] References Cited

U.S. PATENT DOCUMENTS

| | | | |
|---|---|---|---|
| 2,714,066 | 7/1955 | Jewett et al. | 95/8 |
| 2,882,153 | 4/1959 | Cohn | 430/169 |
| 2,882,153 | 4/1959 | Cohn et al. | 96/75 |
| 2,882,154 | 4/1954 | Cohn | 430/159 |
| 2,882,154 | 4/1959 | Cohn et al. | 96/75 |
| 2,922,715 | 1/1960 | Gumbinner | 96/33 |
| 3,181,461 | 5/1965 | Fromson et al. | 101/149.2 |
| 3,276,868 | 10/1966 | Uhlig et al. | 96/1.5 |
| 3,824,159 | 7/1974 | Wehrmann et al. | 204/58 |
| 3,860,426 | 1/1975 | Cunningham et al. | 96/86 |
| 3,902,976 | 9/1975 | Walls | 204/38 A |
| 3,902,976 | 9/1975 | Walls | 204/38 |
| 4,153,461 | 5/1979 | Berghauser et al. | 96/75 |
| 4,301,229 | 11/1981 | Sakaki et al. | 430/278 |

FOREIGN PATENT DOCUMENTS

| | | | |
|---|---|---|---|
| 0016298 | 10/1980 | European Pat. Off. | 96/75 |
| 1162653 | 9/1958 | France | 96/75 |
| 55082695 | 12/1978 | Japan | 96/75 |
| 55109693 | 2/1979 | Japan | 96/75 |
| 1523030 | 8/1978 | United Kingdom | 96/75 |

*Primary Examiner*—R. L. Andrews

*Attorney, Agent, or Firm*—Schwartz, Jeffery, Schwaab, Mack, Blumenthal & Koch

[57] ABSTRACT

A process is disclosed for manufacturing sheets, foils, or strips which involves chemically, mechanically, and/or electrochemically roughening and anodically oxidizing aluminum or aluminum alloy surfaces, followed by two post-treatment steps. In the first step, the metal surface is treated with an aqueous alkali metal silicate solution; thereafter, the surface is treated with an aqueous solution comprising alkaline earth metal ions. The materials produced according to this process are particularly used as supports for offset-printing plates.

6 Claims, No Drawings

PROCESS FOR TREATING ALUMINUM OXIDE LAYERS AND USE IN THE MANUFACTURE OF OFFSET-PRINTING PLATES

BACKGROUND OF THE INVENTION

The present invention relates to a process for post-treating roughened and anodically oxidized aluminum with aqueous solutions of an alkali metal silicate. The treated aluminum is particularly useful as a support material for offset-printing plates.

Support materials for offset-printing plates are provided, on one or both sides, with a radiation-sensitive coating (reproduction coating). The coating is provided either directly by the user or by manufacturers of pre-coated printing plates. This coating permits the photomechanical production of a printing image of an original. Following the production of this printing form from the printing plate, the coating support has image areas which are ink-receptive during the subsequent printing steps. Also, simultaneously with image-production, a hyrophilic image-background for lithographic printing is formed in the areas which are free from an image (non-image areas).

A coating support for reproduction coatings used in the manufacture of offset printing plates must meet the following requirements:

- Those portions of the photosensitive coating which have become comparatively more soluble following exposure must be capable of being easily removed from the support, by a developing operation, in order to produce the hydrophilic non-image areas without leaving a residue.
- The support, which has been laid bare in the non-image areas, must possess a high affinity for water, i.e., it must be strongly hydrophilic, in order to accept water, rapidly and permanently, and to repel greasy printing ink during the lithographic printing operation.
- The photosensitive coating must exhibit an adequate degree of adhesion prior to exposure, and those portions of the coating which print must exhibit adequate adhesion following exposure.

Suitable base materials for coating supports of this kind include aluminum, steel, copper, brass, or zinc foils. Plastic sheets or paper may also be used. By appropriate modifications, such as, for example, graining, matte chromium-plating, surface oxidation, and/or application of an intermediate layer, these base materials are converted into coating supports for offset-printing plates. The surface of the base material, presently most frequently aluminum, is roughened according to known methods, e.g., dry-brushing, slurry-brushing, sandblasting, or chemical and/or electrochemical treatment. In order to increase resistance to abrasion, the roughened substrate may additionally be treated in an anodizing step to produce a thin oxide layer.

In practice, the support materials, and particularly anodically oxidized aluminum-based support materials, are often subjected to a further treatment step, before applying a photosensitive coating, in order to improve the adhesion of the coating, increase the hydrophilic properties of the support material, and/or improve the developability of the photosensitive coatings. Such treatments are, for example, carried out according to the following methods:

German Pat. No. 907,147 (corresponding to U.S. Pat. No. 2,714,066), German Auslegeschrift No. 1,471,707 (corresponding to U.S. Pat. Nos. 3,181,461 and 3,280,734), and German Offenlegungsschrift No. 2,532,769 (corresponding to U.S. Pat. No. 3,902,976) describe processes for hydrophilizing support materials for printing plates made of aluminum which has optionally been anodically oxidized. In these processes, the materials are treated, with or without the application of an electrical current, with an aqueous solution of sodium silicate.

German Pat. No. 1,134,093 (corresponding to U.S. Pat. No. 3,276,868) and German Pat. No. 1,621,478 (corresponding to U.S. Pat. No. 4,153,461) describe the use of polyvinyl phosphonic acid or copolymers based on vinyl phosphonic acid, acrylic acid, and vinyl acetate to hydrophilize support materials for printing plates, comprising aluminum which has optionally been anodically oxidized.

Although these post-treatment methods often yield adequate results, they cannot meet all of the frequently very complex requirements which are demanded of a support material for printing plates, and which comprise the present standards for high-performance printing plates used in practice.

Thus, for example, upon treating the supports with alkali metal silicates which produce a good developability and good hydrophilic properties, a certain deterioration of the storability of the applied reproduction coatings must be accepted. In supports which are treated with water-soluble organic polymers, the good solubility of these polymers, particularly in the aqueous-alkaline developers which are commonly used for developing positive-working reproduction coatings, leads to a decrease in the hydrophilizing action of the post-treatment. In addition, resistance to alkali, which is particularly necessary when high-performance developers are used in the field of positive-working reproduction coatings, is not present to a sufficient degree. Depending on the chemical compositions of the reproduction coatings, tinting in the non-image areas is occasionally encountered. This tinting is probably caused by absorptive effects.

Various modifications of the silicating processes have been described previously. These modifications include, for example:

- Adding surfactants containing non-ionic and anionic moieties and, as optional ingredient, gelatin to an aqueous silicate solution used in an immersion treatment for aluminum printing-plate supports, and subsequently heating the supports, according to Japanese Published Applications No. 55,109,693) published Aug. 23, 1980) or No. 55,082,695 (published June 21, 1980);
- adding a combination of non-ionic and anionic surfactants to aqueous alkali metal silicate solutions used in an immersion treatment for aluminum printing plate supports, at temperatures ranging from 80° to 100° C., according to French Pat. No. 1,162,653;
- adding water-soluble organic polymers, such as, for example, polyvinyl alcohol, polyacrylic acid, polyacrylamide, polysaccharides or polystyrene sulfonic acid, to aqueous alkali metal silicate solutions used in an immersion treatment for aluminum at a temperature exceeding 40° C., according to European Published Application No. 0,016,298, this treatment being especially applicable to aluminum containers;

using a three-step process for producing a hydrophilic adhesive layer on aluminum printing plate supports according to German Auslegeschrift No. 1,118,009 (corresponding to U.S. Pat. No. 2,922,715), comprising the steps of (a) a chemical or mechanical roughening treatment, (b) an immersion treatment at a temperature above 85° C. in an aqueous alkali metal silicate solution, and (c) a final immersion treatment at room temperature in an aqueous solution of citric or tartaric acid, in order to neutralize the alkali produced in step (b);

subjecting silicate layers on aluminum printing-plate supports, which layers were produced by an immersion treatment in aqueous alkali metal silicate solutions, to a hardening after-treatment in an aqueous solution of $Ca(NO_3)_2$ or, generally, in a solution of an alkaline earth metal salt, according to U.S. Pat. Nos. 2,882,153 and 2,882,154, using, as a rule, concentrations of alkaline earth metal salt above 3% by weight, the support materials being only chemically or mechanically roughened, without anodic oxidation treatment;

using a process according to German Offenlegungsschrift No. 2,223,850 (corresponding to U.S. Pat. No. 3,824,159) for coating aluminum moldings, sheets, castings, or foils (for use, inter alia, as offset printing plates, but especially for use in capacitors). This process comprises an anodic oxidation in an aqueous electrolyte composed of an alkali metal silicate and an organic complex-forming compound. Such compounds include amines, amino acids, sulfonic acids, phenols, glycols and, additionally, salts of organic carboxylic acids, for example, maleic acid, fumaric acid, citric acid, or tartaric acid; or using a process for producing grain-like or textured surfaces on aluminum, according to German Auslegeschrift No. 2,651,346 (corresponding to British Pat. No. 1,523,030), which process is carried out directly on the aluminum, using an alternating current in an electrolyte which contains, in an aqueous solution, from 0.01 to 0.5 mol/l of a hydroxide or salt of an alkali metal or alkaline earth metal (e.g., a silicate and, optionally, from 0.01 to 0.5 mol/l of a compound which forms a barrier layer. The reference discloses that compounds that form barrier layers include, among others, citric acid, tartaric acid, succinic acid, lactic acid, malic acid or the salts thereof.

However, these known modifications of silication, anodic oxidation, or surface texturing processes using electrolytes which contain organic acids or the salts thereof, even when they are applicable to aluminum printing plate supports at all, do not produce a surface which is suitable for high-performance printing plates, i.e., technologically, the silicate layers are not improved to such an extent that they fully meet the above-indicated requirements.

German Auslegeschrift No. 2,364,177 (corresponding to U.S. Pat. No. 3,860,426) discloses a hydrophilic adhesion-promoting layer for presensitized lithographic printing plates, which is present on an anodically oxidized aluminum support and comprises a water-soluble salt of Zn, Ca, Mg, Ba, Sr, Co or Mn, in addition to a cellulose ether, for example, sodium carboxymethyl cellulose or hydroxyethyl cellulose. Such adhesion-promoting layers are intended to impart a longer useful life to the plate and to prevent "scumming" in the non-image areas during printing with a printing form produced from this plate. An appreciable increase of the resistance to alkali is, however, not obtained by means of this layer.

In German Offenlegungsschrift No. 3,219,922, a process for post-treating roughened and anodically oxidized aluminum supports for printing plates is described. In this process, an aqueous alkali metal silicate solution of the above-mentioned kind is used, additionally containing an aliphatic monobasic, dibasic or tribasic hydroxycarboxylic acid, an aliphatic dicarboxylic acid, or a water-soluble salt of these acids.

SUMMARY OF THE INVENTION

It is an object of the present invention to provide a process for post-treating sheet aluminum after the anodic oxidation of the aluminum, which process results in an aluminum oxide layer that particularly meets the above-described use requirements for a high-performance printing plate.

It is a further object of the present invention to provide a support for offset-printing plates of improved hydrophilicity in non-image areas, reduced tinting tendency, enhanced resistance to alkali, and a steeper gradation of image.

In accomplishing the foregoing objects, there has been provided, in accordance with one aspect of the present invention, a process for treating a surface of aluminum or of aluminum alloy, which process comprises roughening and anodically oxidizing the surface, then treating the surface with an aqueous alkali metal silicate solution, and, thereafter, treating the surface with an aqueous solution of at least one alkaline earth metal salt.

In accordance with another aspect of the present invention, there has been provided an offset-printing plate comprising a support subjected to a process as described in the preceding paragraph, to which is applied a radiation-sensitive coating.

DETAILED DESCRIPTION OF PREFERRED EMBODIMENTS

The invention proceeds from the known process for manufacturing materials in the form of sheets, foils, or strips which involves chemically, mechanically, and/or electrochemically roughening and anodically oxidizing aluminum or an aluminum alloy and then post-treating the aluminum oxide layers with an aqueous alkali metal silicate solution. In the process of the invention, the treatment (a) with an aqueous alkali metal silicate solution is followed by an additional treatment (b) with an aqueous solution of alkaline earth metal salts.

In preferred embodiments, the alkaline earth metal salts used are water-soluble calcium or strontium salts, particularly nitrates. The solution contains, in particular, from 0.1 to 10% by weight, preferably from 0.5 to 3% by weight, of alkaline earth metal salts.

The two treatment steps (a) and/or (b) can be carried out in an immersion process. Step (a) can also be performed during an electrochemical process. Often the electrochemical process itself causes a certain increase in the resistance to alkali of material which has not yet been subjected to process step (b). For an electrochemical process, direct or alternating current, trapezoidal, rectangular, or triangular current, or superimposed forms of these current types are preferably used. The current density generally ranges from about 0.1 to 10 $A/dm^2$ and/or the voltage ranges from 1 to 100 V;

moreover, the parameters are, for example, also dependent on the electrode distance and the electrolyte composition. Materials can either be discontinuously or continuously treated using modern strip processing equipment. Treating times for each treatment step are appropriately in the range from about 0.5 to 120 seconds, and treating temperatures are about 15° to 80° C., particularly about 20° to 75° C. In general, the aqueous alkali metal silicate solution of step (a) contains from about 0.5 to 15% by weight, particularly from about 0.8 to 12% by weight, of an alkali metal silicate (for example, sodium metasilicate or the sodium trisilicates and sodium tetrasilicates contained in "waterglass"). It is assumed that a firmly adhering covering layer is formed in the pores of the aluminum oxide layer, which protects the oxide against attacks. The previously produced surface topography (e.g., roughness and oxide pores) remains virtually unchanged or is only negligibly changed by the post-treatment, so that the process of the invention is especially suitable for treating materials when it is very important to retain surface topography, such as, for example, in support materials for printing plates.

Suitable base materials for use in the process of the invention, in particular for the manufacture of printing plate supports, include aluminum or an aluminum alloy which contains, for example, more than 98.5% by weight of Al and Si, Fe, Ti, Cu, and Zn constituents.

Before the photosensitive coatings are applied to the aluminum support materials which are conventionally used for printing plates, the supports are roughened by mechanical (e.g., brushing and/or abrasive treatments), chemical (e.g., etchants) or electrochemical processes (e.g., treatment with an alternating current in aqueous acid or salt solutions to which, e.g., corrosion inhibitors, may be added). For the purpose of the present invention, aluminum printing plates which have been electrochemically roughened in aqueous HCl and/or $HNO_3$ solutions are preferably used.

The process parameters in the roughening step, particularly in a continuous procedure, are generally within the following ranges: temperature of the electrolyte between 20° and 60° C., concentration of active substance (acid, salt) between 5 and 100 g/l (or even higher in the case of salts), current density between 15 and 130 A/dm$^2$, dwell time between 10 and 100 seconds, and flow rate of the electrolyte in continuous processes, measured on the surface of the workpiece to be treated, of between 5 and 100 cm/second. The type of current used is in most cases alternating current. It is also possible, however, to use modified current types, e.g., an alternating current with different amplitudes of current strength for the anode and cathode current. The mean peak-to-valley roughness, $R_z$, of the roughened surface is in the range from about 1 to 15 μm, particularly in the range from 2 to 8 μm. The peak-to-valley roughness, $R_z$, is determined according to DIN 4768, October 1970, as the arithmetic mean calculated from the individual peak-to-valley roughness values of five, mutually adjacent, individual measurement lengths.

The roughening process is followed by anodic oxidation of the aluminum in a further process step, in order to improve, for example, the abrasion and adhesion properties of the surface of the support material. Conventional electrolytes, such as $H_2SO_4$, $H_3PO_4$, $H_2C_2O_4$, amidosulfonic acid, sulfosuccinic acid, sulfosalicylic acid, or mixtures thereof, may be used for the anodic oxidation. By way of example, the following standard methods are representative of the use of aqueous electrolytes, containing $H_2SO_4$, for the anodic oxidation of aluminum (see, in this regard, e.g., M. Schenk, Werkstoff Aluminium und seine anodische Oxydation (The Material Aluminum and its Anodic Oxidation), Francke Verlag, Bern, 1948, page 760; Praktische Galvanotechnik (Pratical Electroplating), Eugen G. Leuze Verlag, Saulgau, 1970, pages 395 et seq., and pages 518–519; W. Huebner and C. T. Speiser, Die Praxis der anodischen Oxidation des Aluminiums (Practical Technology of the Anodic Oxidation of Aluminum), Aluminium Verlag, Duesseldorf, 1977, 3rd Edition, pages 137 et seq.):

The direct current sulfuric acid process, in which anodic oxidation is carried out in an aqueous electrolyte which conventionally contains approximately 230 g of $H_2SO_4$ per 1 liter of solution, for 10 to 60 minutes at 10° to 22° C., and at a current density of 0.5 to 2.5 A/dm$^2$. In this process, the sulfuric acid concentration in the aqueous electrolyte solution can also be reduced to 8 to 10% by weight of $H_2SO_4$ (about 100 g of $H_2SO_4$ per liter), or it can also be increased to 30% by weight (365 g of $H_2SO_4$ per liter), or more.

The "hard-anodizing process" is carried out using an aqueous electrolyte, containing $H_2SO_4$ in a concentration of 166 g of $H_2SO_4$ per liter (or about 230 g of $H_2SO_4$ per liter), at an operating temperature of 0° to 5° C., and at a current density of 2 to 3 A/dm$^2$, for 30 to 200 minutes, at a voltage which rises from approximately 25 to 30 V at the beginning of the treatment, to approximately 40 to 100 V toward the end of the treatment.

In addition to the above-described processes for the anodic oxidation of aluminum, the following processes can also be used: the anodic oxidation of aluminum in an aqueous, $H_2SO_4$-containing electrolyte, in which the content of $Al^{3+}$ ions is adjusted to values exceeding 12 g/l (according to German Offenlegungsschrift No. 2,811,396=U.S. Pat. No. 4,211,619), in an aqueous electrolyte containing $H_2SO_4$ and $H_3PO_4$ (according to German Offenlegungsschrift No. 2,707,810=U.S. Pat. No. 4,049,504), or in an aqueous electrolyte containing $H_2SO_4$, $H_3PO_4$ and $Al^{3+}$ ions (according to German Offenlegungsschrift No. 2,836,803=U.S. Pat. No. 4,229,266). Direct current is preferably used for the anodic oxidation, but it is also possible to use alternating current or a combination of these types of current (for example, direct current with superimposed alternating current). The electrolyte is, particularly, a $H_2SO_4$ and/or $H_3PO_4$-containing aqueous solution. The layer weights of aluminum oxide range from 1 to 10 g/m$^2$, which corresponds to a layer thickness of from about 0.3 to 3.0 μm.

Materials which have been pretreated in this manner are particularly used as supports for offset printing plates, i.e., a radiation-sensitive coating is applied to the support material, either by the manufacturers of presensitized printing plates or directly by the user. Suitable radiation-sensitive (photosensitive) coatings basically comprise any coatings which, after irradiation (exposure), optionally followed by development and/or fixing, yield a surface having an image configuration, which can be used for printing.

In addition to the coatings which contain silver halides, which are used in many fields, various other coatings are also known, such as those described, for example, in "Light-Sensitive Systems," by Jaromir Kosar, published by John Wiley & Sons, New York, 1965.

These include colloid coatings containing chromates and dichromates (Kosar, Chapter 2); coatings containing unsaturated compounds which, upon exposure, are isomerized, rearranged, cyclized, or crosslinked (Kosar, Chapter 4); coatings containing compounds which can be photopolymerized, which, upon exposure, undergo polymerization of the monomers or prepolymers, optionally with the aid of an initiator (Kosar, Chapter 5); and coatings containing o-diazoquinones, such as naphthoquinone-diazides, p-diazoquinones, or condensation products of diazonium salts (Kosar, Chapter 7). Other suitable coatings include the electrophotographic coatings, i.e., coatings which contain an inorganic or organic photoconductor. In addition to the photosensitive substances, these coatings can, of course, also contain other constituents, such as for example, resins, dyes or plasticizers. In particular, the following photosensitive compositions or compounds can be employed in the coating of support materials prepared according to the process of the present invention:

positive-working reproduction coatings which contain, as the photosensitive compound, o-quinone diazides, particularly o-naphthoquinone diazides, for example, 1,2-naphthoquinone-2-diazide-sulfonic acid esters or amides, which may have low or higher molecular weights, as described, for example, in German Pat. No. 854,890, No. 865,109, No. 879,203, No. 894,959, No. 938,233, No. 1,109,521, No. 1,144,705, No. 1,118,606, No. 1,120,273, No. 1,124,817 and No. 2,331,377 and in published European Patent Applications No. 0,021,428 and No. 0,055,814;

negative-working reproduction coatings which contain condensation products from aromatic diazonium salts and compounds with active carbonyl groups, preferably condensation products formed from diphenylaminediazonium salts and formaldehyde, which are described, for example, in German Pat. No. 596,731, No. 1,138,399, No. 1,138,400, No. 1,138,401, No. 1,142,871, and No. 1,154,123, U.S. Pat. No. 2,679,498 and No. 3,050,502 and British Pat. No. 712,606;

negative-working reproduction coatings which contain co-condensation products of aromatic diazonium compounds, for example, according to German Offenlegungsschrift No. 2,024,244, comprising products which possess, in each case, at least one unit of (a) an aromatic diazonium salt compound which is capable of condensation and (b) a compound, such as a phenol ether or an aromatic thioether, which is capable of condensation, connected by a bivalent intermediate member derived from a condensable carbonyl compound, for example, a methylene group;

positive-working coatings according to German Offenlegungsschrift No. 2,610,842, German Pat. No. 2,718,254 or German Offenlegungsschrift No. 2,928,636, which contain a compound which, on being irradiated, splits off an acid, a monomeric or polymeric compound which possesses at least one C—O—C group, which can be split off by acid (e.g., an orthocarboxylic acid ester group, or a carboxamide-acetal group), and, if appropriate, a binder;

negative-working coatings, composed of photopolymerizable monomers, photo-initiators, binders and, if appropriate, further additives. In these coatings, for example, acrylic and methacrylic acid esters, or reaction products of diisocyanates with partial esters of polyhydric alcohols, are employed as monomers, as described, for example in U.S. Pat. No. 2,760,863 and No. 3,060,023, and in German Offenlegungsschriften No. 2,064,079 and No. 2,361,041;

negative-working coatings according to German Offenlegungsschrift No. 3,036,077, which contain, as the photo-sensitive compound, a diazonium salt polycondensation product, or an organic azido compound, and which contain, as the binder, a high-molecular weight polymer with alkenylsulfonylurethane or cycloalkenylsulfonylurethane side groups.

It is also possible to apply photo-semiconducting coatings to the support materials manufactured according to the invention, such as described, for example, in German Pat. No. 1,117,391, No. 1,522,497, No. 1,572,312, No. 2,322,046 and No. 2,322,047, resulting in highly photosensitive electrophotographic printing plates.

The coated offset-printing plates which are obtained from the support materials according to the invention are converted into the desired printing form, in a known manner, by imagewise exposure or irradiation, and rinsing the non-image areas with a developer, preferably an aqueous developing solution. Surprisingly, compared to plates in which the same base materials have been post-treated in a one-step process with aqueous solutions which merely contain silicates, offset-printing plates whose base support materials have been post-treated according to the two-step process of the invention exhibit improved hydrophilic properties of the non-image areas, a reduced tendency to tinting, an improved resistance to alkali, and a steeper image gradation (measured with the aid of a continuous-tone step wedge).

In the preceding description and in the examples which follow, percentages always denote percentages by weight, unless otherwise indicated. Parts by weight are related to parts by volume as the g is related to the $cm^3$. Moreover, the following methods were used in the examples for the determination of parameters:

The hydrophilic character of the support materials manufactured according to the invention is tested by measuring the contact angle of a water droplet placed on the support. In this method, the angle formed between the support surface and a tangent line passing through the contact point of the droplet is determined; in general the angle is between 0 and 90 degrees. The better the wetting is, the smaller the angle.

Zincate test (according to U.S. Pat. No. 3,940,321, columns 3 and 4, lines 29 to 68 and lines 1 to 8): The rate, in seconds, at which an aluminum oxide layer dissolves in an alkaline zincate solution is a measure of its resistance to alkali. The longer the layer requires to dissolve, the greater is its resistance to alkali. The layer thicknesses should be approximately comparable, since, of course, they also represent a parameter for the rate of dissolution. A drop of a solution, composed of 500 ml of distilled $H_2O$, 480 g of KOH and 80 g of zinc oxide, is placed on the surface to be tested, and the time which elapses before the appearance of metallic zinc is measured, this event being recognizable by a dark coloration of the test spot.

EXAMPLES 1 TO 23 AND COMPARATIVE EXAMPLES C 1 to C 8

Aluminum foil is electrochemically roughened in a dilute aqueous $HNO_3$ solution, using alternating current, and is then anodically oxidized in a dilute aqueous $H_2SO_4$ solution, using direct current. In the subsequent treatment step (a), samples are immersed in an aqueous solution containing $Na_2SiO_3.5H_2O$ (see Table I for duration, concentration and temperature), then rinsed with distilled $H_2O$ (this intermediate rinsing can be omitted, see Table I) and, after rinsing or directly after silicating, immersed in an aqueous solution of an alkaline earth metal nitrate at room temperature (see Table I for duration, kind of cation, and concentration). Before determining the zincate test time, the contact angle and/or before coating with the photosensitive layer, the samples are again rinsed with distilled $H_2O$ and dried without previously rinsing (see Table I). The contact angles are 74.0° and 19.0° in Comparative Examples C 1 and C 5, respectively, and 7.0° and 11.3° in Examples 9 and 21, respectively. Generally, step (b) is omitted in the Comparative Examples and in one case both steps (a) and (b) are omitted. Table I and the measurements of contact angles show that, compared with prior art products, the hydrophilic character and the resistance to alkali are clearly improved in the products treated according to the invention. Similarly, the application of intermediate rinsing shows a certain influence on the resistance to alkali. Samples which have not been intermediately rinsed after the silicating step generally have a better resistance to alkali than samples which have been intermediately rinsed, but even the latter still have a markedly better alkali resistance than prior art products.

EXAMPLES 24 TO 29

These examples are carried out as indicated for the group comprising Examples 1 to 23, but the silicating step is carried out by an electrochemical process, at room temperature (see Table II).

EXAMPLES 30 TO 33 AND COMPARATIVE EXAMPLES C 9 to C 18

These Examples are carried out as indicated for the group comprising Examples 1 to 23. However, Comparative Examples C 9 to C 14 follow the teaching of U.S. Pat. No. 2,882,154 (however, at a lower salt concentration), using a slurry-brushed support material (abrasive and nylon brushes in C 9 to C 12) and a wire-brushed support material (in C 13 and C 14) which have not been anodically oxidized, Comparative Examples C 15 and C 16, Examples 30 and 31 use a support material which has been slurry-brushed and anodically oxidized in an aqueous solution containing $H_2SO_4$, and Comparative Examples C 17 and C 18 and Examples 32 and 33 use a support material which has been electrochemically roughened and anodically oxidized in an aqueous solution containing $H_3PO_4$. The examples clearly show (see Table III) that, in a mechanically roughened aluminum sample which has not been anodically oxidized, the resistance to alkali is nearly unaffected, or is only insignificantly increased, by a two-step treatment with silicates and alkaline earth metal salts, i.e. based on the teaching of U.S. Pat. No. 2,882,154, the process of the invention and the advantages obtainable therewith could not be anticipated.

TABLE I

| | Silicating | | | | Treating with Alkaline Earth Metal Salt Solution | | | | |
|---|---|---|---|---|---|---|---|---|---|
| Example | Concentration (%) | Temperature (°C.) | Duration (sec) | Intermediate Rinsing | Kind of Cation | Concentration (%) | Duration (sec) | Intermediate Rinsing | Zincate Test (sec) |
| C 1 | — | — | — | — | — | — | — | — | 28 |
| C 2 | 4 | 40 | 1 | no | — | — | — | — | 29 |
| C 3 | 4 | 40 | 5 | " | — | — | — | — | 34 |
| C 4 | 4 | 40 | 10 | " | — | — | — | — | 38 |
| C 5 | 4 | 40 | 30 | " | — | — | — | — | 38 |
| C 6 | 4 | 40 | 60 | " | — | — | — | — | 45 |
| 1 | 4 | 40 | 1 | " | $Ca^{2+}$ | 0.10 | 10 | no | 61 |
| 2 | 4 | 40 | 5 | " | " | 0.10 | 10 | " | 64 |
| 3 | 4 | 40 | 10 | " | " | 0.10 | 10 | " | 66 |
| 4 | 4 | 40 | 30 | " | " | 0.10 | 10 | " | 72 |
| 5 | 4 | 40 | 60 | " | " | 0.10 | 10 | " | 80 |
| 6 | 4 | 25 | 30 | yes | " | 0.01 | 10 | yes | 36 |
| 7 | 4 | 25 | 30 | " | " | 0.10 | 10 | " | 48 |
| 8 | 4 | 25 | 30 | " | " | 1.00 | 10 | " | 59 |
| 9 | 4 | 25 | 30 | no | " | 1.00 | 10 | no | 90 |
| 10 | 4 | 25 | 30 | yes | $Sr^{2+}$ | 0.01 | 10 | yes | 38 |
| 11 | 4 | 25 | 30 | " | " | 0.10 | 10 | " | 57 |
| 12 | 4 | 25 | 30 | " | " | 1.00 | 10 | " | 72 |
| 13 | 1 | 25 | 1 | no | " | 0.10 | 1 | " | 38 |
| 14 | 1 | 25 | 1 | " | " | 10.00 | 1 | " | 67 |
| 15 | 1 | 70 | 1 | " | " | 0.10 | 1 | " | 34 |
| 16 | 1 | 70 | 1 | " | " | 10.00 | 1 | " | 112 |
| C 7 | 4 | 25 | 30 | yes | — | — | — | — | 27 |
| C 8 | 4+ | 25 | 30 | " | — | — | — | — | 32 |
| 17 | 4 | 25 | 30 | no | $Sr^{2+}$ | 1.00 | 10 | yes | 84 |
| 18 | 4+ | 25 | 30 | " | " | 1.00 | 10 | " | 66 |
| 19 | 1 | 25 | 30 | " | " | 1.00 | 10 | no | 69 |
| 20 | 2 | 25 | 30 | " | " | 1.00 | 10 | " | 111 |
| 21 | 4 | 25 | 30 | " | " | 1.00 | 10 | " | 153 |
| 22 | 10 | 25 | 30 | " | " | 1.00 | 10 | " | 167 |
| 23 | 4 | 25 | 30 | " | $Ba^{2+}$ | 1.00 | 10 | " | 35 |

+ in these Examples waterglass is used instead of $N_2SiO_3.5H_2O$

TABLE II

| Example | Silicating Concentration (%) | Silicating Voltage (V) | Silicating Duration (sec) | Intermediate Rinsing | Treating with Alkaline Earth Metal Salt Solution: Kind of Cation | Concentration (%) | Duration (sec) | Intermediate Rinsing | Zincate Test (sec) |
|---|---|---|---|---|---|---|---|---|---|
| 24 | 4 | 20 | 30 | no | $Sr^{2+}$ | 1.00 | 10 | yes | 90 |
| 25 | 4 | 20 | 60 | " | " | 1.00 | 10 | " | 82 |
| 26 | 4 | 40 | 30 | " | " | 1.00 | 10 | " | 99 |
| 27 | 4 | 40 | 60 | " | " | 1.00 | 10 | " | 116 |
| 28 | 4 | 60 | 30 | " | " | 1.00 | 10 | " | 128 |
| 29 | 4 | 60 | 30 | " | " | 1.00 | 10 | " | 126 |

TABLE III

| Example | Silicating Concentration (%) | Silicating Temperature (°C.) | Silicating Duration (sec) | Intermediate Rinsing | Treating with Alkaline Earth Metal Salt Solution: Kind of Cation | Concentration (%) | Duration (sec) | Intermediate Rinsing | Zincate Test (sec) |
|---|---|---|---|---|---|---|---|---|---|
| C 9 | — | — | — | — | — | — | — | — | 13 |
| C 10 | 4 | 25 | 30 | yes | — | — | — | — | 13 |
| C 11 | 4 | 25 | 30 | no | $Sr^{2+}$ | 1.00 | 10 | yes | 16 |
| C 12 | 4 | 25 | 30 | yes | " | 1.00 | 10 | " | 13 |
| C 13 | — | — | — | — | — | — | — | — | 10 |
| C 14 | 4 | 25 | 30 | no | $Sr^{2+}$ | 1.00 | 10 | yes | 11 |
| C 15 | — | — | — | — | — | — | — | — | 28 |
| C 16 | 4 | 25 | 30 | yes | — | — | — | — | 29 |
| 30 | 4 | 25 | 30 | no | $Sr^{2+}$ | 1.00 | 10 | yes | 41 |
| 31 | 4 | 25 | 30 | yes | " | 1.00 | 10 | " | 41 |
| C 17 | — | — | — | — | — | — | — | — | 95 |
| C 18 | 4 | 25 | 30 | yes | — | — | — | — | 101 |
| 32 | 4 | 25 | 30 | no | $Sr^{2+}$ | 1.00 | 10 | yes | 130 |
| 33 | 4 | 25 | 30 | yes | " | 1.00 | 10 | " | 120 |

EXAMPLE 34

A support material prepared as indicated in Example 17 is coated with the following positive-working photosensitive composition:

6.00 parts by weight of a cresol/formaldehyde novolak (with softening range of 105° to 120° C., according to DIN 53 181), 1.10 parts by weight of 4-(2-phenyl-prop-2-yl)-phenyl-1, 2-naphthoquinone-2-diazide-4-sulfonate, 0.81 part by weight of polyvinyl butyral, 0.75 part by weight of 1,2-naphthoquinone-2-diazide-4-sulfochloride, 0.08 part by weight of crystal violet, 91.36 parts by weight of a mixture composed of 4 parts by volume of ethylene glycol monomethyl ether, 5 parts by volume of tetrahydrofuran, and 1 part by volume of butyl acetate.

The printing form obtained after exposure and development yields a print run of 100,000 copies.

EXAMPLE 35

A support material prepared as indicated in Example 17 is coated with the following negative-working photosensitive composition:

50.0 parts by weight of the reaction product obtained by reacting a polyvinyl butyral (having a molecular weight of 80,000 and containing 75% of polyvinyl butyral units, 1% of vinyl acetate units and 20% of vinyl alcohol units) with propenylsulfonyl isocyanate having an acid number of 140, 16.5 parts by weight of the polycondensation product of 1 mole of 3-methoxydiphenylamine-4-diazonium-sulfate and 1 mole of 4,4'-bismethoxymethyl-diphenylether, condensed in an 85% strength $H_3PO_4$ and precipitated as the salt of mesitylene sulfonic acid, 1.5 parts by weight of an 85% strength $H_3PO_4$, 2.0 parts by weight of Victoria Pure Blue FGA, 1.0 part by weight of phenylazodiphenylamine, 2,500.0 parts by weight of ethylene glycol monomethyl ether.

The printing form obtained after exposure and development yields a print run of over 150,000 copies.

COMPARATIVE EXAMPLE C 19

The example is carried out as indicated in Example 35, but the two-step treatment with silicates and alkaline earth metal salts is replaced by a post-treatment with an aqueous solution of polyvinyl phosphonic acid. In C 19, the gradation of the image area is about one to two wedge steps softer (i.e. less steep) than in Example 35, and a print run of about 130,000 copies is obtained.

COMPARATIVE EXAMPLES C 20 AND C 21

These examples are carried out as in Examples 1 to 23. However, the two-step treatment with silicates and alkaline earth metal salts is not applied; instead, the roughened and oxidized aluminum samples are immersed for 30 seconds at 25° C. in aqueous solutions containing 2 g/l of sodium carboxymethyl cellulose (having a viscosity of 300 mPa.s in C 20 and a viscosity of 30.000 mPa.s in C 21 and having a degree of substitution of about 0.7, in each case) and 2 g/l of $Sr(NO_3)_2$ (in accordance with German Auslegeschrift No. 2,364,177). In these two Comparative Examples, the zincate test times are about 31 seconds for samples which have not been rinsed after post-treating and about 25 seconds for samples which have been rinsed with distilled $H_2O$. This kind of post-treatment has practically no influence or only a slight influence on the resistance of the oxide layer to alkali.

What is claimed is:

1. A process for using an offset printing plate comprising an aluminum or an aluminum alloy support subjected to (1) electrochemical roughening in an aqueous solution containing at least one of HCl and $HNO_3$; (2) anodic oxidation in an aqueous solution containing at least one of $H_2SO_4$ and $H_3PO_4$; (3) treatment in an aqueous alkali metal silicate solution, wherein said solution comprises from about 0.5 to 10% by weight of alkali metal silicate; and thereafter (4) treatment in an aqueous solution comprising at least one alkaline earth metal salt, wherein said solution comprises from about 0.1 to 10% by weight of alkaline earth metal salt, thereby forming a hydrophilic layer on said surface, said process comprising the steps of:

(A) applying a radiation-sensitive coating to said support;

(B) imagewise exposing said coating; and thereafter (C) developing said coating in an alkali developer, whereby said hydrophilic layer resists attack by said alkali developer.

2. A process as in claim 1, wherein the alkaline earth metal salt is selected from water-soluble calcium or strontium salts.

3. A process as in claim 2, wherein the alkaline earth metal salt is a nitrate.

4. A process as in claim 1, wherein the aqueous solution of at least one alkaline earth metal salt comprises from about 0.5 to 3 percent by weight of alkaline earth metal salt.

5. A process as in claim 1, wherein said treatment (3) of said support in an aqueous metal silicate solution is carried out electrochemically at a current density of from about 0.1 to 10 $A/dm^2$ and/or a voltage of from about 1 to 100 V.

6. A process as in claim 1, wherein said treatment (3) of said support in an aqueous metal silicate solution and said treatment (4) of said support in an aqueous solution comprising at least one alkaline earth metal salt are both carried out for a period of from about 0.5 to 120 seconds and at a temperature of from about 15° to 80° C.

* * * * *